US007741258B2

(12) United States Patent
Fujitsu et al.

(10) Patent No.: US 7,741,258 B2
(45) Date of Patent: Jun. 22, 2010

(54) LUBRICATING OIL COMPOSITION

(75) Inventors: Takashi Fujitsu, Kanagawa (JP); Joanna Griffiths, Chester (GB)

(73) Assignee: Shell Oil Company, Houston, TX (US)

( * ) Notice: Subject to any disclaimer, the term of this patent is extended or adjusted under 35 U.S.C. 154(b) by 59 days.

(21) Appl. No.: 11/677,386

(22) Filed: Feb. 21, 2007

(65) Prior Publication Data

US 2008/0280795 A1 Nov. 13, 2008

(30) Foreign Application Priority Data

Feb. 21, 2006 (EP) ..... 06250923

(51) Int. Cl.
*C10M 161/00* (2006.01)
*C10M 129/74* (2006.01)
*C10M 145/14* (2006.01)

(52) U.S. Cl. ..... 508/469; 508/472; 508/485; 508/486; 508/501

(58) Field of Classification Search ..... 508/472, 508/465, 501, 486, 469, 485
See application file for complete search history.

(56) References Cited

U.S. PATENT DOCUMENTS

| | | | | |
|---|---|---|---|---|
| 3,506,574 | A | 4/1970 | Stambaugh | 252/51.5 |
| 3,933,659 | A | 1/1976 | Lyle et al. | 252/32.7 |
| 4,282,106 | A * | 8/1981 | Schaap et al. | 508/334 |
| 4,683,069 | A | 7/1987 | Brewster et al. | 252/32.7 |
| 5,114,603 | A | 5/1992 | Kennedy et al. | 252/56 R |
| 5,286,394 | A | 2/1994 | Moore | 252/36 |
| 6,204,224 | B1 | 3/2001 | Quintero et al. | 507/123 |
| 6,331,510 | B1 | 12/2001 | Curtis et al. | 508/578 |
| 6,372,696 | B1 | 4/2002 | Tipton | 508/110 |
| 6,562,765 | B1 | 5/2003 | Boffa | 508/221 |
| 2005/0148477 | A1 * | 7/2005 | Friend et al. | 508/291 |

FOREIGN PATENT DOCUMENTS

| | | |
|---|---|---|
| EP | 0335701 A2 | 10/1989 |
| EP | 0668342 A1 | 2/1995 |
| EP | 0776959 A2 | 6/1997 |
| EP | 0905221 A1 | 3/1999 |
| EP | 0730021 B1 | 1/2000 |
| EP | 1041135 A1 | 3/2000 |
| EP | 0730022 B1 | 4/2000 |
| EP | 0747464 B1 | 7/2001 |
| EP | 0750031 B1 | 8/2001 |
| EP | 0799883 B1 | 10/2001 |
| EP | 1367116 A1 | 12/2003 |
| GB | 2097813 A | 11/1982 |
| JP | 53050291 | 5/1978 |
| JP | 53056610 | 5/1978 |
| JP | 56120679 | 9/1981 |
| JP | 58171488 | 10/1983 |
| WO | WO9202602 | 2/1992 |
| WO | WO9721788 | 6/1997 |

(Continued)

*Primary Examiner*—Ellen M McAvoy
*Assistant Examiner*—Ming Cheung Po

(57) ABSTRACT

A lubricating oil composition comprising base oil, one or more glycerol esters selected from glycerol monooleate and/or glycerol dioleate, optionally in combination with glycerol trioleate, wherein said composition further comprises one or more dispersant-viscosity index improver compounds and an additive amount of one or more additional polyhydric alcohol esters; and a method of lubricating an internal combustion engine comprising applying said lubricating oil composition thereto.

8 Claims, 1 Drawing Sheet

FOREIGN PATENT DOCUMENTS

| | | |
|---|---|---|
| WO | WO9826030 | 6/1998 |
| WO | WO9920720 | 4/1999 |
| WO | WO9931113 | 6/1999 |
| WO | WO9941332 | 8/1999 |
| WO | WO9947629 | 9/1999 |
| WO | WO9950377 | 10/1999 |
| WO | WO9966013 | 12/1999 |
| WO | WO0008115 | 2/2000 |
| WO | WO0014179 | 3/2000 |
| WO | WO0014183 | 3/2000 |
| WO | WO0014187 | 3/2000 |
| WO | WO0014188 | 3/2000 |
| WO | WO0015736 | 3/2000 |
| WO | WO0118156 A1 | 3/2001 |
| WO | WO0157166 A1 | 8/2001 |

* cited by examiner

LUBRICATING OIL COMPOSITION

RELATED CASES

The present application claims priority from European application 06250923.7, filed Feb. 21, 2006, which is incorporated herein by reference.

FIELD OF THE INVENTION

The present invention relates to a lubricating oil composition, and in particular to a lubricating oil composition that is suitable for lubricating internal combustion engines and has improved friction reduction and fuel economy.

BACKGROUND OF THE INVENTION

Increasingly severe automobile regulations in respect of emissions and fuel efficiency are placing increasing demands on both engine manufacturers and lubricant formulators to provide effective solutions to improve fuel economy.

Optimising lubricants through the use of high performance basestocks and novel additives represents a flexible solution to a growing challenge.

Friction-reducing additives (which are also known as friction modifiers) are important lubricant components in reducing fuel consumption and various such additives are already known in the art. Friction modifiers can be conveniently divided into two categories, that is to say, metal-containing friction modifiers and ashless (organic) friction modifiers.

Organo-molybdenum compounds are among the most common metal-containing friction modifiers. Typical organo-molybdenum compounds include molybdenum dithiocarbamates (MoDTC), molybdenum dithiophosphates (MoDTP), molybdenum amines, molybdenum alcoholates, and molybdenum alcohol-amides. WO-A-98/26030, WO-A-99/31113, WO-A-99/47629 and WO-A-99/66013 describe tri-nuclear molybdenum compounds for use in lubricating oil compositions.

However, the trend towards low-ash lubricating oil compositions has resulted in an increased drive to achieve low friction and improved fuel economy using ashless (organic) friction modifiers.

Ashless (organic) friction modifiers typically comprise esters of fatty acids and polyhydric alcohols, fatty acid amides, amines derived from fatty acids and organic dithiocarbamate or dithiophosphate compounds. Further improvements in lubricant performance characteristics have been achieved through the use of synergistic behaviours of particular combinations of lubricant additives.

WO-A-99/50377 discloses a lubricating oil composition which is said to have a significant increase in fuel economy due to the use therein of tri-nuclear molybdenum compounds in conjunction with oil soluble dithiocarbamates.

EP-A-1041135 discloses the use of succinimide dispersants in conjunction with molybdenum dialkyldithiocarbamates to give improved friction reduction in diesel engines.

U.S. Pat. No. 6,562,765 discloses a lubricating oil composition which is said to have a synergy between an oxymolybdenum nitrogen dispersant complex and an oxymolybdenum dithiocarbamate which leads to unexpectedly low friction coefficients.

EP-A-1367116, EP-A-0799883, EP-A-0747464, U.S. Pat. No. 3,933,659 and EP-A-335701 disclose lubricating oil compositions comprising various combinations of ashless friction modifiers.

WO-A-92/02602 describes lubricating oil compositions for internal combustion engines which comprise a blend of ashless friction modifiers which are said to have a synergistic effect on fuel economy.

The blend disclosed in WO-A-92/02602 is a combination of (a) an amine/amide friction modifier prepared by reacting one or more acids with one or more polyamines and (b) an ester/alcohol friction modifier prepared by reacting one or more acids with one or more polyols.

U.S. Pat. No. 5,114,603 and U.S. Pat. No. 4,683,069 describe lubricating oil compositions comprising mixtures of glycerol monooleate and glycerol dioleate in combination with other additives which were added for their conventional purpose.

EP-A-0747464 describes a lubricating oil composition for automatic transmissions which comprises alkoxylated fatty amines as well as a mixture of two friction modifiers which are selected from a large list of possible compounds. While said list includes glycerol esters, it is of note that there are no examples in EP-A-0747464 which comprise glycerol esters as friction modifiers.

U.S. Pat. No. 5,286,394 discloses a friction-reducing lubricating oil composition and a method for reducing the fuel consumption of an internal combustion engine. The lubricating oil composition disclosed therein comprises a major amount of an oil having lubricating viscosity and a minor amount of a friction-modifying, polar and surface active organic compound selected from a long list of compounds including mono- and higher esters of polyols and aliphatic amides. Glycerol monooleate and oleamide (i.e. oleylamide) are mentioned as examples of such compounds.

However, current strategies with regard to friction reduction for fuel economy oils are not sufficient to meet ever-increasing fuel economy targets set by Original Equipment Manufacturers (OEMs).

For example, molybdenum friction modifiers typically outperform ashless friction modifiers in the boundary regime and there is a challenge to approach similar levels of friction modification using solely ashless friction modifiers.

Thus, given the increasing fuel economy demands placed on engines, there remains a need to further improve the friction reduction and fuel economy of internal combustion engines utilising low ash lubricating oil compositions. It is therefore desirable to further improve on the performance of known ashless friction modifiers and known combinations of ashless friction modifiers, in particular to further improve on the friction-reducing performance of polyol ester friction modifiers such as glycerol monooleate that have been commonly used in the art.

SUMMARY OF THE INVENTION

There has now been surprisingly found in the present invention a lubricating oil composition that has good friction reduction and fuel economy.

Accordingly, the present invention provides a lubricating oil composition comprising base oil, one or more glycerol esters selected from glycerol monooleate, and/or glycerol dioleate, optionally in combination with glycerol trioleate, wherein said composition further comprises one or more dispersant-viscosity index improver compounds and an additive amount of one or more additional polyhydric alcohol esters.

BRIEF DESCRIPTION OF THE DRAWINGS

Advantages of the present invention will become apparent to those skilled in the art with the benefit of the following detailed description of embodiments and upon reference to the accompanying drawings, in which.

DETAILED DESCRIPTION OF PREFERRED EMBODIMENTS

Figure 1:
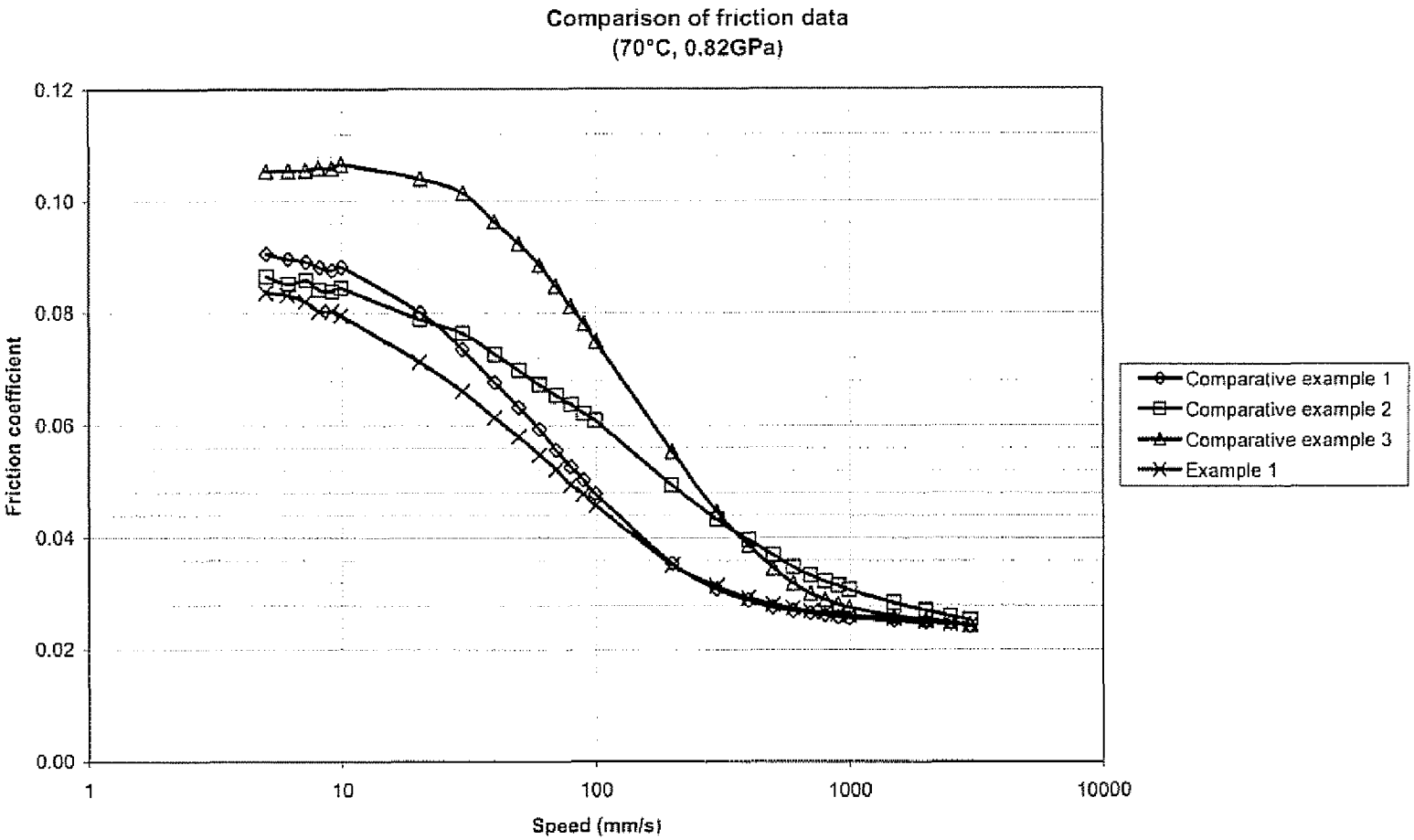
FIG. 1 represents graphically the results of Table 2, which were obtained under a low load of 0.82 GPa at 70° C. for Example 1 and Comparative Examples 1 to 3.

It will be appreciated that glycerol monooleate has two possible structures, that is to say structures (a) and (b) indicated below.

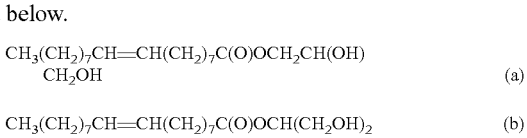

$$CH_3(CH_2)_7CH{=}CH(CH_2)_7C(O)OCH_2CH(OH)CH_2OH \quad (a)$$

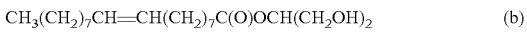

$$CH_3(CH_2)_7CH{=}CH(CH_2)_7C(O)OCH(CH_2OH)_2 \quad (b)$$

Glycerol monooleate used in the lubricating oil composition of the present invention may be conveniently present as a compound having structure (a), a compound having structure (b), or mixtures thereof.

It will be further appreciated that glycerol dioleate also has two possible structures, that is to say structures (c) and (d) indicated below.

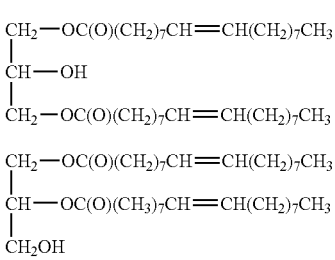

$$\begin{array}{l} CH_2{-}OC(O)(CH_2)_7CH{=}CH(CH_2)_7CH_3 \\ | \\ CH{-}OH \\ | \\ CH_2{-}OC(O)(CH_2)_7CH{=}CH(CH_2)_7CH_3 \end{array} \quad (c)$$

$$\begin{array}{l} CH_2{-}OC(O)(CH_2)_7CH{=}CH(CH_2)_7CH_3 \\ | \\ CH{-}OC(O)(CH_3)_7CH{=}CH(CH_2)_7CH_3 \\ | \\ CH_2OH \end{array} \quad (d)$$

Glycerol dioleate used in the lubricating oil composition of the present invention may be conveniently present as a compound having structure (c), a compound having structure (d), or mixtures thereof.

Commercially available glycerol monooleate may contain minor amounts of glycerol dioleate and glycerol trioleate.

In a preferred embodiment of the present invention, the one or more glycerol esters are present in a total amount in the range of from 0.05 to 5.0 wt. %, more preferably in the range of from 0.5 to 3.0 wt. % and most preferably in the range of from 0.7 to 1.5 wt. %, based on the total weight of the lubricating oil composition.

By "an additive amount of one or more additional polyhydric alcohol esters" in the present invention, is meant that said one or more additional polyhydric alcohol esters are preferably present in a total amount in the range of from 0.1 to 2.0 wt. %, based on the total weight of the lubricating oil composition.

Said one or more additional polyhydric alcohol esters are more preferably present in a total amount in the range of from 0.1 to 1.0 wt. %, based on the total weight of the lubricating oil composition.

Preferred additional polyhydric alcohol esters include other glycerol esters such as glycerol stearates, for example glycerol monostearate, neopentyl glycol esters such as neopentyl glycol oleates, pentaerythritol esters such as pentaerythritol oleates and trimethylolpropane (TMP) esters such as trimethylolpropane oleates and trimethylolpropane stearates.

The one or more additional polyhydric alcohol esters present in the lubricating oil composition of the present invention may be fully or partially esterified esters.

Dispersant-viscosity index improver compounds are multi-functional compounds that in addition to acting as viscosity index improvers also exhibit dispersant behaviour.

Such compounds are well known in the art and have been described in many publications, for example, Chapter 5 ("Viscosity index improvers and thickeners") by R. L. Stambaugh in "Chemistry and Technology of Lubricants", eds., R. M. Mortier, S. T. Orszulik, Blackie/VCH, 1992, pp. 124.

Such compounds may be conveniently prepared by conventional methods and may be generally prepared as described in the afore-mentioned reference. For example, amongst others, said compounds may also be prepared according to the methods described in EP-A-0730022, EP-A-0730021, U.S. Pat. No. 3,506,574 and EP-A2-0750031.

Examples of dispersant-viscosity index improver compounds that may be conveniently used include those described in U.S. Pat. No. 6,331,510, U.S. Pat. No. 6,204,224 and U.S. Pat. No. 6,372,696.

Examples of dispersant-viscosity index improver compounds include those available ex. RohMax under the trade designations "Acryloid 985", "VISCOPLEX 6-325", "Viscoplex 6-054", "Viscoplex 6-954" and "Viscoplex 6-565" and that available ex. The Lubrizol Corporation under the trade designation "LZ 7720C".

Particularly preferred dispersant-viscosity index improver compounds that may be conveniently employed in the present invention are polyalkylene glycol-polymethacrylate copolymers. The polyalkylene glycol moieties therein may comprise branched or unbranched alkylene groups.

Examples of polyalkylene glycol-polymethacrylate copolymers that may be conveniently used are polyethylene glycol-polymethacrylate copolymers and polypropylene glycol-polymethacrylate copolymers.

Polyalkylene glycol-polymethacrylate copolymers which are especially preferred for use as dispersant-viscosity index improver compounds in the present invention include compounds according to formula I,

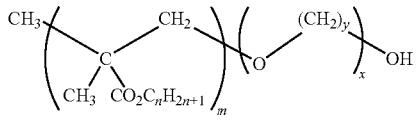

(I)

wherein n is an integer in the range of from 1 to 20, preferably 10 to 20, m is an integer in the range of from 75 to 200, y is an integer in the range of from 2 to 6 and x is an integer in the range of from 200 to 600

Examples of most preferred dispersant-viscosity index improver compounds that may be conveniently employed in the present invention include polyethylene glycol-polymethacrylate co-polymers.

Polyethylene glycol-polymethacrylate co-polymers which are especially preferred for use as dispersant-viscosity index improver compounds in the present invention include compounds according to formula II,

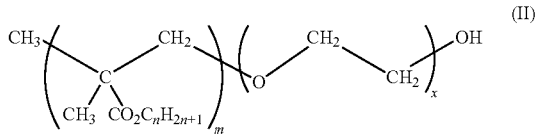

(II)

wherein n is an integer in the range of from 1 to 20, preferably 10 to 20, m is an integer in the range of from 75 to 200 and x is an integer in the range of from 200 to 600.

Preferred polyalkylene glycol-polymethacrylate copolymers dispersant-viscosity index improver compounds that may be conveniently used in the present invention include but are not limited to the viscosity index improver that is available under the trade designation "VISCOPLEX 6-325" from RohMax.

In a preferred embodiment of the present invention, the one or more dispersant-viscosity index improver compounds are present in a total amount in the range of from 0.1 to 10 wt. % more preferably in the range of from 002 to 7 wt. % and most preferably in the range of from 0.5 to 4 wt. %, based on the total weight of the lubricating oil composition.

The total amount of base oil incorporated in the lubricating oil composition of the present invention is preferably present in an amount in the range of from 60 to 92 wt. %, more preferably in an amount in the range of from 75 to 90 wt. % and most preferably in an amount in the range of from 75 to 88 wt. %, with respect to the total weight of the lubricating oil composition.

There are no particular limitations regarding the base oil used in the present invention, and various conventional known mineral oils and synthetic oils may be conveniently used.

The base oil used in the present invention may conveniently comprise mixtures of one or more mineral oils and/or one or more synthetic oils. Mineral oils include liquid petroleum oils and solvent-treated or acid-treated mineral lubricating oil of the paraffinic, naphthenic, or mixed paraffinic/naphthenic type which may be further refined by hydrofinishing processes and/or dewaxing.

Naphthenic base oils have low viscosity index (VI) (generally 40-80) and a low pour point. Such base oils are produced from feedstocks rich in naphthenes and low in wax content and are used mainly for lubricants in which colour and colour stability are important, and VI and oxidation stability are of secondary importance.

Paraffinic base oils have higher VI (generally >95) and a high pour point. Said base oils are produced from feedstocks rich in paraffins, and are used for lubricants in which VI and oxidation stability are important.

Fischer-Tropsch derived base oils may be conveniently used as the base oil in the lubricating oil composition of the present invention, for example, the Fischer-Tropsch derived base oils disclosed in EP-A-776959, EP-A-668342, WO-A-97/21788, WO-00/15736, WO-00/14188, WO-00/14187, WO-00/14183, WO-00/14179, WO-00/08115, WO-99/41332, EP-1029029, WO-01/18156 and WO-01/57166.

Synthetic processes enable molecules to be built from simpler substances or to have their structures modified to give the precise properties required.

Synthetic oils include hydrocarbon oils such as olefin oligomers (PAOs), dibasic acid esters, polyol esters, and dewaxed waxy raffinate. Synthetic hydrocarbon base oils sold by the Shell Group under the designation "XHVI"™ may be conveniently used.

Preferably, the base oil is constituted from mineral oils and/or synthetic oils which contain more than 80% wt of saturates, preferably more than 90% wt., as measured according to ASTM D2007. It is further preferred that the base oil contains less than 1.0 wt. %, preferably less than 0.1 wt. % of sulphur, calculated as elemental sulphur and measured according to ASTM D2622, ASTM D4294, ASTM D4927 or ASTM D3120.

Preferably, the viscosity index of base fluid is more than 80, more preferably more than 120, as measured according to ASTM D2270. Preferably, the lubricating oil composition has a kinematic viscosity in the range of from 2 to 80 $mm^2/s$ at 100° C., more preferably in the range of from 3 to 70 $mm^2/s$, most preferably in the range of from 4 to 50 $mm^2/s$.

The total amount of phosphorus in the lubricating oil composition of the present invention is preferably in the range of from 0.04 to 0.1 wt. %, more preferably in the range of from 0.04 to 0.09 wt. % and most preferably in the range of from 0.045 to 0.09 wt. %, based on total weight of the lubricating oil composition.

The lubricating oil composition of the present invention preferably has a sulphated ash content of not greater than 1.0 wt. %, more preferably not greater than 0.75 wt. % and most preferably not greater than 0.7 wt. %, based on the total weight of the lubricating oil composition.

The lubricating oil composition of the present invention preferably has a sulphur content of not greater than 1.2 wt. %, more preferably not greater than 0.8 wt. % and most preferably not greater than 0.2 wt. %, based on the total weight of the lubricating oil composition.

The lubricating oil composition of the present invention may further comprise additional additives such as anti-oxidants, anti-wear additives, detergents, dispersants, friction modifiers, viscosity index improvers, pour point depressants, corrosion inhibitors, defoaming agents and seal fix or seal compatibility agents.

Antioxidants that may be conveniently used include those selected from the group of aminic antioxidants and/or phenolic antioxidants.

In a preferred embodiment, said antioxidants are present in an amount in the range of from 0.1 to 5.0 wt. %, more preferably in an amount in the range of from 0.3 to 3.0 wt. %, and most preferably in an amount of in the range of from 0.5 to 1.5 wt. %, based on the total weight of the lubricating oil composition.

Examples of aminic antioxidants which may be conveniently used include alkylated diphenylamines, phenyl-α-naphthylamines, phenyl-β-naphthylamines and alkylated α-naphthylamines.

Preferred aminic antioxidants include dialkyldiphenylamines such as p,p'-dioctyl-diphenylamine, p,p'-di-α-methylbenzyl-diphenylamine and N-p-butylphenyl-N-p'-octylphenylamine, monoalkyldiphenylamines such as mono-t-butyldiphenylamine and mono-octyldiphenylamine, bis(dialkylphenyl)amines such as di-(2,4-diethylphenyl)amine and di(2-ethyl-4-nonylphenyl)amine, alkylphenyl-1-naphthylamines such as octylphenyl-1-naphthylamine and n-t-dodecylphenyl-1-naphthylamine, 1-naphthylamine, arylnaphthylamines such as phenyl-1-naphthylamine, phenyl-2-naphthylamine, N-hexylphenyl-2-naphthylamine and N-octylphenyl-2-naphthylamine, phenylenediamines such as N,N'-diisopropyl-p-phenylenediamine and N,N'-diphenyl-p-phenylenediamine, and phenothiazines such as phenothiazine and 3,7-dioctylphenothiazine.

Preferred aminic antioxidants include those available under the following trade designations: "Sonoflex OD-3" (ex.

Seiko Kagaku Co.), "Irganox L-57" (ex. Ciba Specialty Chemicals Co.) and phenothiazine (ex. Hodogaya Kagaku Co.).

Examples of phenolic antioxidants which may be conveniently used include C7-C9 branched alkyl esters of 3,5-bis(1,1-dimethyl-ethyl)-4-hydroxy-benzenepropanoic acid, 2-t-butylphenol, 2-t-butyl-4-methylphenol, 2-t-butyl-5-methylphenol, 2,4-di-t-butylphenol, 2,4-dimethyl-6-t-butylphenol, 2-t-butyl-4-methoxyphenol, 3-t-butyl-4-methoxyphenol, 2,5-di-t-butylhydroquinone, 2,6-di-t-butyl-4-alkylphenols such as 2,6-di-t-butylphenol, 2,6-di-t-butyl-4-methylphenol and 2,6-di-t-butyl-4-ethylphenol, 2,6-di-t-butyl-4-alkoxyphenols such as 2,6-di-t-butyl-4-methoxyphenol and 2,6-di-t-butyl-4-ethoxyphenol, 3,5-di-t-butyl-4-hydroxybenzylmercaptooctylacetate, alkyl-3-(3,5-di-t-butyl-A-hydroxyphenyl)propionates such as n-octadecyl-3-(3,5-di-t-butyl-4-hydroxyphenyl)propionate, n-butyl-3-(3,5-di-t-butyl-4-hydroxyphenyl)propionate and 2'-ethylhexyl-3-(3,5-di-t-butyl-4-hydroxyphenyl)propionate, 2,6-d-t-butyl-α-dimethylamino-p-cresol, 2,2'-methylenebis(4-alkyl-6-t-butylphenol) such as 2,2'-methylenebis(4-methyl-6-t-butylphenol, and 2,2-methylenebis(4-ethyl-6-t-butylphenol), bisphenols such as 4,4'-butylidenebis(3-methyl-6-t-butylphenol, 4,4'-methylenebis(2,6-di-t-butylphenol), 4,4'-bis(2,6-di-t-butylphenol), 2,2-(di-p-hydroxyphenyl)propane, 2,2-bis(3,5-di-t-butyl-4-hydroxyphenyl)propane, 4,4'-cyclohexylidenebis(2,6-t-butylphenol), hexamethyleneglycol-bis[3-(3,5-di-t-butyl-4-hydroxyphenyl)propionate], triethyleneglycolbis[3-(3-t-butyl-4-hydroxy-5-methylphenyl)propionate], 2,2'-thio-[diethyl-3-(3,5-di-t-butyl-4-hydroxyphenyl)propionate], 3,9-bis{1,1-dimethyl-2-[3-(3-t-butyl-4-hydroxy-5-methylphenyl)-propionyloxy]ethyl}2,4,8,10-tetraoxaspiro[5,5]undecane, 4,4'-thiobis(3-methyl-6-t-butylphenol) and 2,21-thiobis(4,6-di-t-butylresorcinol), polyphenols such as tetrakis[methylene-3-(3,5-di-t-butyl-4-hydroxyphenyl)propionate]methane, 1,1,3-tris(2-methyl-4-hydroxy-5-t-butylphenyl)butane, 1,3,5-trimethyl-2,4,6-tris(3,5-di-t-butyl-4-hydroxybenzyl)benzene, bis-[3,3'-bis(4'-hydroxy-3'-t-butylphenyl)butyric acid]glycol ester, 2-(3',5'-di-t-butyl-4-hydroxyphenyl)methyl-4-(2",4"-di-t-butyl-3"-hydroxyphenyl)methyl-6-t-butylphenol and 2,6-bis(2'-hydroxy-3'-t-butyl-5'-methylbenzyl)-4-methylphenol, and p-t-butylphenol-formaldehyde condensates and p-t-butylphenol-acetaldehyde condensates.

Preferred phenolic antioxidants include those available under the following trade designations: "Irganox L-135" (ex. Ciba Specialty Chemicals Co.), "Yoshinox SS" (ex. Yoshitomi Seiyaku Co.), "Antage W-400" (ex. Kawaguchi Kagaku Co.), "Antage W-500" (ex. Kawaguchi Kagaku Co.), "Antage W-300" (ex. Kawaguchi Kagaku Co.), "Irganox L-109" (ex. Ciba Speciality Chemicals Co.), "Tominox 917" (ex. Yoshitomi Seiyaku Co.), "Irganox L-115" (ex. Ciba Speciality Chemicals Co.), "Sumilizer GA80" (ex. Sumitomo Kagaku), "Antage RC" (ex. Kawaguchi Kagaku Co.), "Irganox L-101" (ex. Ciba Speciality Chemicals Co.), "Yoshinox 930" (ex. Yoshitomi Seiyaku Co.).

The lubricating oil composition of the present invention may comprise mixtures of one or more phenolic antioxidants with one or more aminic antioxidants.

In a preferred embodiment, the lubricating oil composition may comprise a single zinc dithiophosphate or a combination of two or more zinc dithiophosphates as anti-wear additives, the or each zinc dithiophosphate being selected from zinc dialkyl-, diaryl- or alkylaryl-dithiophosphates.

Zinc dithiophosphate is a well known additive in the art and may be conveniently represented by general formula III,

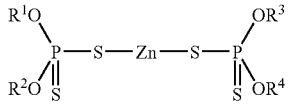

(III)

wherein $R^1$ to $R^4$ may be the same or different and are each a primary alkyl group containing from 1 to 20 carbon atoms preferably from 3 to 12 carbon atoms, a secondary alkyl group containing from 3 to 20 carbon atoms, preferably from 3 to 12 carbon atoms, an aryl group or an aryl group substituted with an alkyl group, said alkyl substituent containing from 1 to 20 carbon atoms preferably 3 to 18 carbon atoms.

Zinc dithiophosphate compounds in which R1 to R4 are all different from each other can be used alone or in admixture with zinc dithiophosphate compounds in which R1 to R4 are all the same.

Preferably, the or each zinc dithiophosphate used in the present invention is a zinc dialkyl dithiophosphate.

Examples of suitable zinc dithiophosphates which are commercially available include those available ex. Lubrizol Corporation under the trade designations "Lz 1097" and "Lz 1395", those available ex. Chevron Oronite under the trade designations "OLOA 267" and "OLOA 269R", and that available ex. Afton Chemical under the trade designation "HITEC 7197"; zinc dithiophosphates such as those available ex. Lubrizol Corporation under the trade designations "Lz 677A", "Lz 1095" and "Lz 1371", that available ex. Chevron Oronite under the trade designation "OLOA 262" and that available ex. Afton Chemical under the trade designation "HITEC 7169"; and zinc dithiophosphates such as those available ex. Lubrizol Corporation under the trade designations "Lz 1370" and "Lz 1373" and that available ex. Chevron Oronite under the trade designation "OLOA 260".

The lubricating oil composition according to the present invention may generally comprise in the range of from 0.4 to 1.0 wt. % of zinc dithiophosphate, based on total weight of the lubricating oil composition.

Additional or alternative anti-wear additives may be conveniently used in the lubricating oil composition of the present invention.

Typical detergents that may be used in the lubricating oil composition of the present invention include one or more salicylate and/or phenate and/or sulphonate detergents. However, as metal organic and inorganic base salts that are used as detergents can contribute to the sulphated ash content of a lubricating oil composition, in a preferred embodiment of the present invention, the amounts of such additives are minimised.

Furthermore, in order to maintain a low sulphur level, salicylate detergents are preferred. Thus, in a preferred embodiment, the lubricating oil composition of the present invention may comprise one or more salicylate detergents.

In order to maintain the total sulphated ash content of the lubricating oil composition of the present invention at a level of preferably not greater than 1.0 wt. %, more preferably at a level of not greater than 0.75 wt. % and most preferably at a level of not greater than 0.7 wt. %, based on the total weight of the lubricating oil composition, said detergents are preferably used in amounts in the range of 0.05 to 12.5 wt. %, more preferably from 1.0 to 9.0 wt. % and most preferably in the range of from 2.0 to 5.0 wt. %, based on the total weight of the lubricating oil composition.

Furthermore, it is preferred that said detergents, independently, have a TBN (total base number) value in the range of from 10 to 500 mg.KOH/g, more preferably in the range of from 30 to 350 mg.KOH/g and most preferably in the range of from 50 to 300 mg.KOH/g, as measured by ISO 3771.

The lubricating oil compositions of the present invention may additionally contain an ash-free dispersant which is preferably admixed in an amount in the range of from 5 to 15 wt. %, based on the total weight of the lubricating oil composition.

Examples of ash-free dispersants which may be used include the polyalkenyl succinimides and polyalkenyl succininic acid esters disclosed in Japanese Laid-Open Patent Application Nos. JP 53-050291 A, JP 56-120679 A, JP 53-056610 A and JP 58-171488 A. Preferred dispersants include borated succinimides.

Examples of further viscosity index improver improvers which may conveniently used in the lubricating oil composition of the present invention include the styrene-butadiene copolymers, styrene-isoprene stellate copolymers and the polymethacrylate copolymer and ethylene-propylene copolymers. Such viscosity index improver improvers may be conveniently employed in an amount in the range of from 1 to 20 wt. %, based on the total weight of the lubricating oil composition.

Polymethacrylates may be conveniently employed in the lubricating oil compositions of the present invention as effective pour point depressants.

Furthermore, compounds such as alkenyl succinic acid or ester moieties thereof, benzotriazole-based compounds and thiodiazole-based compounds may be conveniently used in the lubricating oil composition of the present invention as corrosion inhibitors.

Compounds such as polysiloxanes, dimethyl polycyclohexane and polyacrylates may be conveniently used in the lubricating oil composition of the present invention as defoaming agents.

Compounds which may be conveniently used in the lubricating oil composition of the present invention as seal fix or seal compatibility agents include, for example, commercially available aromatic esters.

The lubricating oil compositions of the present invention may be conveniently prepared by admixing the one or more glycerol esters selected from glycerol monooleate and/or glycerol dioleate, optionally in combination with glycerol trioleate, one or more dispersant-viscosity index improver compounds and an additive amount of one or more additional polyhydric alcohol esters and, optionally, further additives that are usually present in lubricating oil compositions, for example as herein before described, with mineral and/or synthetic base oil.

In another embodiment of the present invention, there is provided a method of lubricating an internal combustion engine comprising applying a lubricating oil composition as hereinbefore described thereto.

The present invention further provides the use of a combination of one or more glycerol esters selected from glycerol monooleate and/or glycerol dioleate, optionally in combination with glycerol trioleate, one or more dispersant-viscosity index improver compounds and an additive amount of one or more additional polyhydric alcohol esters in a lubricating oil composition in order to improve fuel economy and/or friction reduction.

The present invention is described below with reference to the following Examples, which are not intended to limit the scope of the present invention in any way.

Examples

Formulations

Table 1 indicates the formulations that were tested. The formulations in Table 1 comprised conventional detergents, dispersants, antioxidants and zinc dithiophosphate additives, which were present as additive packages in diluent oil. The base oils used in said formulations were mixtures of polyalphaolefin base oils (PAO-4 available from BP Amoco under the trade designation "DURASYN 164" and PAO-5 available from Chevron Oronite under the trade designation "SYNFLUID 5"). The conventional viscosity index improver that was used was an isoprene-styrene viscosity index (VI) improver available under the trade designation "INFINEUM SV300" from Infineum. The dispersant-viscosity index (VI) improver that was used a polyethylene glycol-polymethacrylate (PEG-PMA) copolymer available under the trade designation "VISCOPLEX 6-325" from RohMax.

The glycerol monooleate that was used was that available under the trade designation "RADIASURF 7149" from Oleon Chemicals. Said component is primarily glycerol monooleate with minor amounts of glycerol dioleate and glycerol trioleate. The additional polyhydric alcohol ester that was used was trimethylol propane (TMP) monooleate available under the trade designation "ADEKA FM-10" from Asahi Denka Kogyo Co. Ltd. The oleylamide used was that available under the trade designation "UNISLIP 1757" from Uniqema. All formulations described in Table 1 were SAE 0W20 viscosity grade oils.

Said formulations were manufactured by blending together the components therein in a single stage blending procedure at a temperature of 70° C. Heating was maintained for a minimum of 30 minutes to ensure thorough mixing, whilst the solution was mixed using a paddle stirrer.

TABLE 1

| Additive (wt. %) | Ex. 1 | Comp. Ex. 1 | Comp. Ex. 2 | Comp. Ex. 3 |
|---|---|---|---|---|
| Anti-foam | 30 ppm | 30 ppm | 30 ppm | 30 ppm |
| Additive package[1] | 10.9 | 10.9 | 10.9 | 10.9 |
| Glycerol Monooleate | 1.0 | 1.5 | 1.5 | 1.0 |
| Trimethylol propane monooleate | 0.5 | — | — | 0.5 |
| Isoprene-styrene VI improver | — | 2.7 | — | 2.7 |
| PEG-PMA dispersant-VI improver | 2.9 | — | 2.9 | — |
| Oleylamide | — | 0.2 | 0.2 | — |
| PAO-4 Base Oil | 33.9 | 33.9 | 33.9 | 33.9 |
| PAO-5 Base Oil | 50.8 | 50.8 | 50.6 | 51.0 |
| TOTAL | 100 | 100 | 100 | 100 |

[1]Conventional additive package containing calcium salicylate detergents having TBNs of 165 mg · KOH/g and 280 mg · KOH/g, dispersant, pour point depressant, aminic and phenolic antioxidants, zinc dithiophosphate additives and diluent oil.

Mini-Traction Machine (MTM) Test

Friction measurements were carried out on a Mini-Traction Machine manufactured by PCS instruments.

The MTM Test was described by R. I. Taylor, E. Nagatomi, N. R. Horswill, D. M. James in "A screener test for the fuel economy potential of engine lubricants", presented at the 13th International Colloquium on Tribology, January 2002.

Friction coefficients were measured with the Mini-Traction Machine using the 'ball-on-disc' configuration. The ball specimen was a polished steel ball bearing, 19.05 mm in diameter. The disc specimen was a polished bearing steel disc, 46 mm in diameter and 6 mm thick. The ball specimen was secured concentrically on a motor driven shaft. The disc specimen was secured concentrically on another motor driven shaft. The ball was loaded against the disc to create a point contact area with minimum spin and skew components. At the point of contact, a slide to roll ratio of 100% was maintained by adjusting the surface speed of the ball and disc.

The tests were run at a pressure of 0.82 GPa (load of 20N) with variable temperatures and mean surface speeds as detailed in Table 2.

Results and Discussion

The formulations described in Table 1 were tested using the afore-mentioned test and the results obtained thereon are detailed below:

Testing Under Low Load Conditions

The formulations of Example 1 and Comparative Examples 1 to 3 were tested in the MTM test under low load conditions (0.82 GPa). Testing was carried out under a variety of temperature conditions (45° C., 70° C., 105° C. and 125° C.) and speeds (2000, 1000, 500, 100, 50 and 10 mm/s).

Friction coefficients were measured and are described in Table 2.

TABLE 2

| MTM Test Conditions | | | Comp. | Comp. | Comp. |
|---|---|---|---|---|---|
| Temp. (° C.) | Speed (mm/s) | Ex. 1 | Ex. 1 | Ex. 2 | Ex 3 |
| | | | Friction Coefficient | | |
| 125 | 2000 | 0.0180 | 0.0161 | 0.0215 | 0.0193 |
| 125 | 1000 | 0.0219 | 0.0170 | 0.0272 | 0.0282 |
| 125 | 500 | 0.0314 | 0.0224 | 0.0351 | 0.0469 |
| 125 | 100 | 0.0327 | 0.0591 | 0.0563 | 0.0892 |
| 125 | 50 | 0.0714 | 0.0713 | 0.0638 | 0.0981 |
| 125 | 10 | 0.0786 | 0.0808 | 0.0696 | 0.0938 |
| 105 | 2000 | 0.0196 | 0.0185 | 0.0245 | 0.0209 |
| 105 | 1000 | 0.0213 | 0.0197 | 0.0314 | 0.0277 |
| 105 | 500 | 0.0279 | 0.0242 | 0.0404 | 0.0445 |
| 105 | 100 | 0.0571 | 0.0551 | 0.0641 | 0.0906 |
| 105 | 50 | 0.0673 | 0.0689 | 0.0717 | 0.1022 |
| 105 | 10 | 0.0789 | 0.0808 | 0.0804 | 0.1026 |
| 70 | 2000 | 0.0250 | 0.0248 | 0.0271 | 0.0255 |
| 70 | 1000 | 0.0261 | 0.0257 | 0.0307 | 0.0276 |
| 70 | 500 | 0.0280 | 0.0276 | 0.0369 | 0.0345 |
| 70 | 100 | 0.0457 | 0.0478 | 0.0609 | 0.0749 |
| 70 | 50 | 0.0579 | 0.0632 | 0.0698 | 0.0924 |
| 70 | 10 | 0.0795 | 0.0882 | 0.0844 | 0.1066 |
| 45 | 2000 | 0.0297 | 0.0297 | 0.0305 | 0.0302 |
| 45 | 1000 | 0.0321 | 0.0319 | 0.0337 | 0.0329 |
| 45 | 500 | 0.0336 | 0.0335 | 0.0375 | 0.0354 |
| 45 | 100 | 0.0415 | 0.0433 | 0.0551 | 0.0604 |
| 45 | 50 | 0.0498 | 0.0548 | 0.0652 | 0.0775 |
| 45 | 10 | 0.0754 | 0.0836 | 0.0837 | 0.1049 |

FIG. 1 represents graphically the results of Table 2 which were obtained under a low load of 0.82 GPa at 70° C. for Example 1 and Comparative Examples 1 to 3. Such conditions are typical of those found in the valve train of an engine.

Comparative Example 1 in FIG. 1 shows the friction coefficients exhibited under low load conditions (0.82 GPa) by a lubricating oil composition comprising a conventional friction modifier combination of glycerol monooleate (GMO) and oleylamide with a standard viscosity index improver.

In contrast, it is apparent from FIG. 1 that the use in Comparative Example 2 of a dispersant-viscosity index improver gives rise to higher friction coefficients at the higher speeds.

The lubricating oil composition of Comparative Example 3 comprises a combination of GMO and TMP monooleate with a standard viscosity index improver. FIG. 1 shows that the lubricating oil composition of Comparative Example 3 exhibits much higher friction coefficients than the GMO/oleylamide/standard viscosity index improver combination of Comparative Example 1.

The lubricating oil composition of Example 1 comprises a combination of GMO and TMP monooleate with a dispersant viscosity index improver. In spite of the poor results displayed in Comparative Examples 2 and 3 for the use of GMO/dispersant viscosity index improver and GMO/TMP monooleate combinations, it is apparent from FIG. 1 that the use of a GMO, TMP monooleate and dispersant viscosity index improver additive combination in Example 1 gives rise to a synergistic friction reduction. Indeed, the additive combination in Example 1 even outperforms the commonly used GMO/oleylamide friction modifier combination of Comparative Example 1.

While preferred embodiments have been described above, it will be understood that various modifications can be made without departing from the scope of the invention, which is to be defined solely by the claims that follow

The invention claimed is:

1. A lubricating oil composition comprising base oil, one or more glycerol esters selected from glycerol monooleate and/or glycerol dioleate, optionally in combination with glycerol trioleate, wherein said composition further comprises one or more dispersant-viscosity index improver compounds and an additive amount of one or more additional polyhydric alcohol esters;

wherein said one or more dispersant-viscosity index improver compounds are selected from the group consisting of compounds according to formula I,

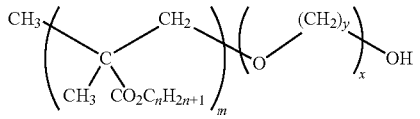

(I)

wherein n is an integer in the range of from 1 to 20, m is an integer in the range of from 75 to 200, y is an integer in the range of from 2 to 6 and x is an integer in the range of from 200 to 600.

2. The lubricating oil composition according to claim 1, wherein said one or more glycerol esters are present in a total amount in the range of from 0.05 to 5.0 wt. %, based on the total weight of the lubricating oil composition.

3. The lubricating oil composition according to claim 1, wherein said one or more additional polyhydric alcohol esters are present in a total amount in the range of from 0.1 to 2.0 wt. %, based on the total weight of the lubricating oil composition.

4. The lubricating oil composition according to claim 1, wherein said one or more additional polyhydric alcohol esters are selected from the group consisting of glycerol stearates, neopentyl glycol esters such as neopentyl glycol oleates, pentaerythritol esters such as pentaerythritol oleates and trimethylolpropane (TMP) esters such as trimethylolpropane oleates, trimethylolpropane stearates, and combinations thereof.

5. The lubricating oil composition according to claim 1, wherein said one or more dispersant-viscosity index improver compounds are present in a total amount in the range of from 0.1 to 10 wt. %, based on the total weight of the lubricating oil composition.

6. The lubricating oil composition according to claim 1, wherein the lubricating oil composition has a total amount of phosphorus in the range of from 0.04 to 0.1 wt. % and/or a sulphur content of not greater than 1.2 wt. %, based on total weight of the lubricating oil composition.

7. The lubricating oil composition according to claim 1, wherein the lubricating oil composition has a sulphated ash content not greater than 1.0 wt. %, based on the total weight of the lubricating oil composition.

8. A method of lubricating an internal combustion engine comprising applying a lubricating oil composition according to claim 1.

* * * * *